US009972484B2

(12) United States Patent
Lazorin et al.

(10) Patent No.: US 9,972,484 B2
(45) Date of Patent: May 15, 2018

(54) PLASMA ILLUMINATION DEVICE WITH MICROWAVE PUMP

(71) Applicant: NovStream LLC, Moscow (RU)

(72) Inventors: Vitaly Vladimirovich Lazorin, Moscow (RU); Anatoly Isaakovich Pipko, Moscow (RU); Nikolay Igorevich Skripkin, Domodedovo (RU)

(73) Assignee: NovStream LLC Moscow (RU)

( * ) Notice: Subject to any disclaimer, the term of this patent is extended or adjusted under 35 U.S.C. 154(b) by 0 days. days.

(21) Appl. No.: 15/519,095

(22) PCT Filed: Oct. 7, 2015

(86) PCT No.: PCT/RU2015/000651
§ 371 (c)(1),
(2) Date: Apr. 13, 2017

(87) PCT Pub. No.: WO2016/060590
PCT Pub. Date: Apr. 21, 2016

(65) Prior Publication Data

US 2017/0271142 A1 Sep. 21, 2017

(30) Foreign Application Priority Data

Oct. 14, 2014 (RU) ..... 2014141360

(51) Int. Cl.
*H01J 61/52* (2006.01)
*H01J 65/04* (2006.01)
(Continued)

(52) U.S. Cl.
CPC ..... *H01J 65/044* (2013.01); *H01J 61/30* (2013.01); *H01J 61/36* (2013.01); *H01J 61/52* (2013.01)

(58) Field of Classification Search
None
See application file for complete search history.

(56) References Cited

U.S. PATENT DOCUMENTS 5,866,990 A * 2/1999 Ury ..... H01J 61/52 315/112
6,608,443 B1 * 8/2003 Bae ..... H01J 65/044 315/248
(Continued)

FOREIGN PATENT DOCUMENTS

RU 2043704 C1 9/1995
RU 2225659 C2 3/2004
(Continued)

OTHER PUBLICATIONS

International Search Report for PCT/RU2015/000651, dated Feb. 11, 2016.

*Primary Examiner* — Douglas W Owens
*Assistant Examiner* — Srinivas Sathiraju
(74) *Attorney, Agent, or Firm* — Merchant & Gould P.C.

(57) ABSTRACT

The present disclosure describes a plasma illumination device with microwave pumping, comprising: a hermetically sealed casing, a magnetron, a microwave resonator containing a rotatable electrodeless plasma lamp, a coaxial coupling line running parallel to the casing axis, for transmitting microwave power from the magnetron to the microwave resonator, at least one heat sink located on the inner walls of the casing and providing heat transfer through the casing to the external environment, and a light-transmitting hermetically sealed hollow cylinder fitted in a hermetically sealed way on the casing above the microwave resonator. This results in an illumination device with microwave pumping, which may be used to illuminate objects located in unfavorable environmental conditions, particularly those in which there is a high content of dust or other contaminants, or in an aqueous environment at great depths.

12 Claims, 5 Drawing Sheets

(51) Int. Cl.
*H01J 61/30* (2006.01)
*H01J 61/36* (2006.01)

(56) References Cited

U.S. PATENT DOCUMENTS

| | | | | |
|---|---|---|---|---|
| 7,233,100 | B2 * | 6/2007 | Hea | H01J 65/044 313/113 |
| 2009/0213617 | A1 * | 8/2009 | Sander | G02B 21/0012 362/575 |
| 2011/0006682 | A1 * | 1/2011 | Kim | H01J 65/044 315/39 |
| 2012/0074839 | A1 * | 3/2012 | Kando | H01J 61/86 315/34 |
| 2014/0158280 | A1 * | 6/2014 | Kurimura | B32B 37/12 156/64 |
| 2015/0123537 | A1 * | 5/2015 | Kato | H01J 65/044 315/34 |
| 2017/0271142 | A1 * | 9/2017 | Lazorin | H01J 65/044 |

FOREIGN PATENT DOCUMENTS

| | | | |
|---|---|---|---|
| RU | 2390870 | C1 | 5/2010 |
| RU | 114225 | U1 | 3/2012 |

* cited by examiner

PLASMA ILLUMINATION DEVICE WITH MICROWAVE PUMP

This application is a National Stage Application of PCT/RS2015/000651, filed Oct. 7, 2015, which claims benefit of Russian Patent Application No. 2014141360, filed Oct. 14, 2014, which applications are incorporated herein by reference. A claim of priority is made to each of the above applications.

TECHNICAL FIELD

The present invention relates to the field of lighting engineering, and more precisely to an illumination device with microwave pumping, which may be used to illuminate objects located in unfavorable environmental conditions, particularly those in which there is a high content of dust or other contaminants, or in an aqueous environment at great depths.

PRIOR ART

There is a known illumination device based on an electrodeless gas discharge lamp with microwave pumping (see, for example, utility model patent RU 114225 U1), which, when the gas discharge lamp bulb is rotated, makes it possible to achieve the longest possible service life of the main structural elements, namely the burner bulb and the magnetron. The excitation device of an electrodeless microwave gas discharge lamp comprises a burner with a bulb of optically transparent material filled with a plasma-forming substance, positioned in a microwave resonator with a reflector and attached to the shaft of an electric motor, a microwave generator in the form of a magnetron connected to the microwave resonator by a waveguide, and a high-voltage generator connected to the cathode and filament of the magnetron, the anode of which is grounded. By adding a rotation sensor attached to the electric motor shaft, a temperature sensor attached to the magnetron casing, threshold devices for the limit temperature of the burner bulb and the limit temperature of the magnetron, an emergency cut-out unit, and an emergency cut-out indicator, it is possible to provide continuous control of the rotation speed of the electric motor shaft, monitoring of changes in the bulb temperature, and continuous control of the magnetron temperature. If there is any abnormal operation of the electric motor and/or overheating of the magnetron, the emergency cut-out unit switches off the high-voltage generator and simultaneously switches on the emergency cut-out indicator, thereby increasing the reliability of operation and the service life of the proposed illumination device in difficult operating conditions.

The structure of the aforesaid illumination device is not hermetically sealed, making it impossible to use the aforesaid device in corrosive environments or as a source of underwater illumination.

The most similar technical solution examined is an illumination device disclosed in patent RU 2225659, comprising a casing in which are placed a magnetron for generating microwave power, a bulb for generating light under the action of the microwave power, a waveguide to link the magnetron to the bulb and to transfer the microwave power generated in the magnetron to the bulb, and a high-voltage generator. The casing is hermetically sealed and in close contact with the outer surface of the magnetron and high-voltage generator, in order to radiate the heat generated in the magnetron. On the outer surface of the casing there are pins designed to intensify the dissipation of the heat evolved inside the illumination device.

This illumination device is not entirely hermetically sealed, since the mesh screen is not protected in any way; consequently, the external environment may act on the elements present inside the casing, including those operating at high voltage, and especially the plasma bulb which is at a high temperature. Because of this, the illumination device cannot be used in corrosive environments or under water, or in conditions of high humidity; it is not compact, and therefore cannot be used for working at great depths, that is to say when there is a large pressure differential. Owing to the presence of the pins, the casing of the illumination device has a highly complex shape, which is rather difficult to manufacture, while having large overall dimensions in the transverse direction, which also hinder its use in aqueous environments at great depths.

SUMMARY OF THE INVENTION

The present invention is based on the problem of providing a plasma illumination device having a compact, hermetically sealed structure, providing better heat dissipation and a longer service life, and capable of operation in various environmental conditions including extreme conditions, for example in an aqueous environment at great depths or in rarefied atmospheres.

The aforesaid problem is resolved by the provision of a plasma illumination device with microwave pumping, comprising:

a hermetically sealed casing, equipped with a cover with an opening, in which a magnetron and a power source, supplying power to the magnetron, are placed along the axis, a microwave resonator, positioned coaxially with the casing and having light-transmitting side and end walls and a light-reflecting bottom, fitted in the opening in the cover of the casing, and an electrodeless plasma lamp, fitted in the microwave resonator in the antinodal region and rotatable on a support rod which is attached at its other end to the drive shaft and which has an axis coaxial with the casing axis, a coaxial coupling line running parallel to the casing axis, for transmitting microwave power from the magnetron to the microwave resonator, this line having a coupling loop at the end located in the microwave resonator, the illumination device comprising a plurality of heat sinks located on the inner walls of the casing and providing heat transfer from the magnetron and power source, which are located in the casing and generate heat, through the wall of the casing to the external environment, and a light-transmitting hermetically sealed hollow cylinder, fitted coaxially and in a hermetically sealed way on the cover of the casing above the microwave resonator, and designed to protect the microwave resonator from the effects of environmental factors.

Preferably, the illumination device also comprises a rotation sensor, fitted in the immediate proximity of the attached end of the support rod and designed to indicate the presence of rotation of the electrodeless plasma lamp on the basis of the rotation of the support rod, and a control unit fitted in the hermetically sealed casing to ensure the synchronized operation of the power unit, the magnetron and the support rod drive.

Preferably, the magnetron, control unit and support rod drive of the electrodeless plasma lamp are attached to a chassis in the casing.

Preferably, to enable the device to be used at depth, the casing is cylindrical in shape, with the axes of the magnetron and the power source parallel to the casing axis.

Preferably, the casing is spherical in shape, with the axes of the magnetron and the power source parallel to the casing axis.

Preferably, the casing is spherical in shape, with the axes of the magnetron and the power source perpendicular to the casing axis.

Preferably, the drive for rotating the support rod is fitted in the casing, coaxially with the casing.

Preferably, the shape of the bottom of the resonator is flat. Alternatively, it may be parabolic or spherical.

Preferably, the illumination device also comprises a cooling means fitted in the casing.

Preferably, the cooling means is made in the form of a fan.

Preferably, the illumination device also comprises a radiator made in the form of ribs fitted on the outer cylindrical surface of the casing.

The proposed plasma illumination device has a compact, hermetically sealed structure, providing better heat dissipation and a longer service life, and is capable of operation in various environmental conditions including extreme conditions, for example in an aqueous environment at great depths or in rarefied atmospheres. The casing of the illumination device has a simple structure which is easy to manufacture, and small overall dimensions in the transverse direction, particularly if the casing is cylindrical in shape, thus also facilitating the use of the device in aqueous environments at great depths.

BRIEF DESCRIPTION OF THE DRAWINGS

The invention is explained below by a description of preferred variant embodiments with reference to the appended drawings, in which.

DESCRIPTION OF PREFERRED VARIANT EMBODIMENTS OF THE INVENTION

Figure 1:
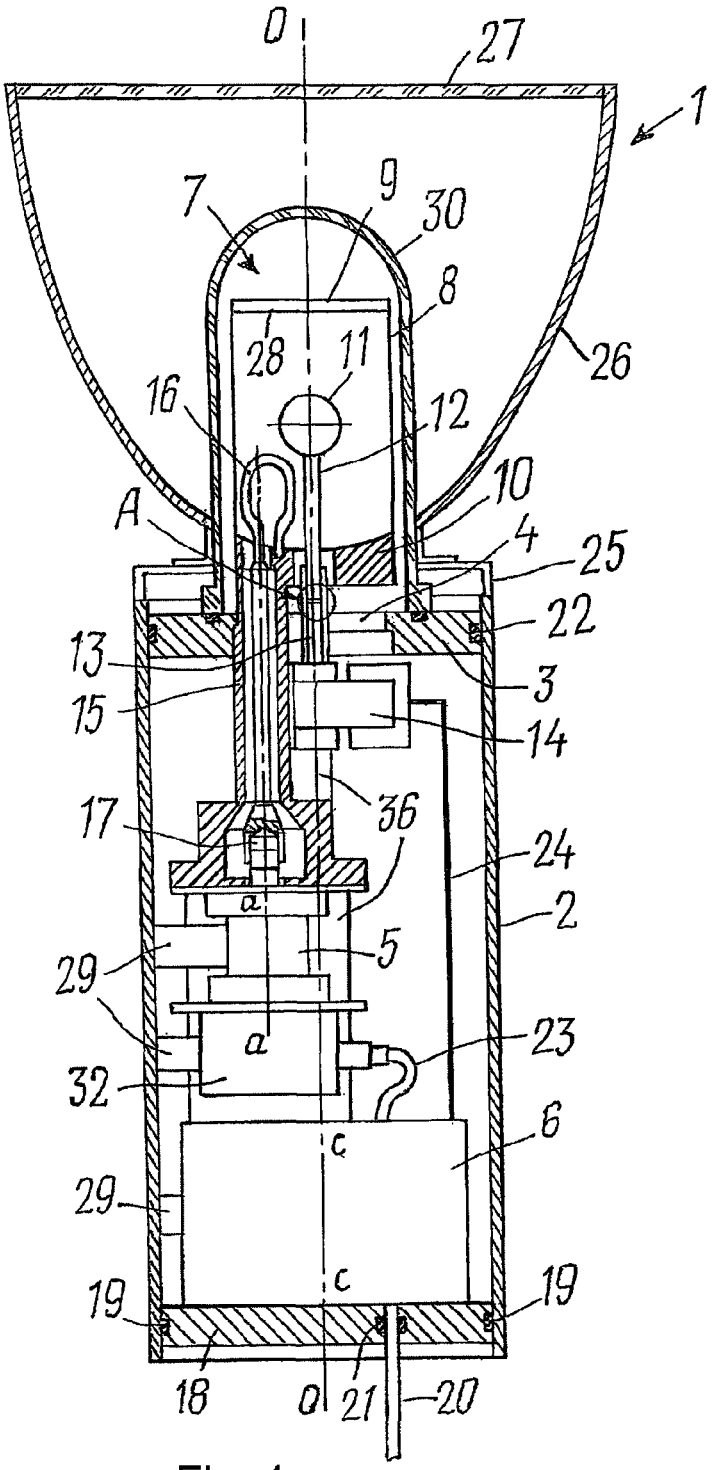
FIG. 1 shows schematically a plasma illumination device, in longitudinal section, the casing of which is made in a cylindrical shape while the reflector is parabolic, according to the invention.

A plasma illumination device 1 (FIG. 1) with microwave pumping comprises a hermetically sealed casing 2, equipped with a cover 3 with an opening 4. A magnetron 5 and a power source 6, supplying power to the magnetron 5, are placed in the casing 2 along the axis 0-0.

A microwave resonator 7 is positioned in the opening 4 in the cover 3 of the casing 2 coaxially with the casing, and has light-transmitting side 8 and end 9 walls and a light-reflecting bottom 10.

The illumination device 1 comprises an electrodeless plasma lamp 11, fitted in the microwave resonator 7 in the antinodal region and rotatable on a support rod 12 which is attached at its other end to the shaft 13 of the drive 14 and which has an axis coaxial with the axis 0-0 of the casing 2. The bulb of the lamp 11 is filled with plasma-forming substances which emit light under the action of microwave power.

A coaxial coupling line 15 runs parallel to the axis 0-0 of the casing 2 and enables the microwave power to be transmitted from the magnetron 5 to the microwave resonator 7. The coaxial coupling line 15 has a coupling loop 16 at its end, located in the microwave resonator 7. The other end of the coaxial line 15 is connected to the magnetron 5 by means of a spring clip 17.

In the variant embodiment described here, the casing 2 is cylindrical in shape.

By using a coaxial line 15 for transmitting microwave power from the magnetron 5 to the light-transmitting microwave resonator 7, all the elements of the illumination device 1 can be placed in a compact manner in the cylindrical casing 2, the end of which is hermetically sealed by a flange 18 and seals 19.

The electrical power supply to the illumination device 1 is transmitted by means of a cable 20, the entry of which through the flange 18 is hermetically sealed by a seal 21.

The hermetic seal of the cover 3 of the casing 2 is provided by seals 22, and the connection between the power supply unit 6, the magnetron 5 and the drive 14 is provided by the cables 23 and 24.

A reflector 26, covered by a protective glass 27, is attached to the outside of the casing 2 by means of the intermediate flange 25. In the variant described here, the reflector 26 is made in a parabolic shape.

Figure 2:
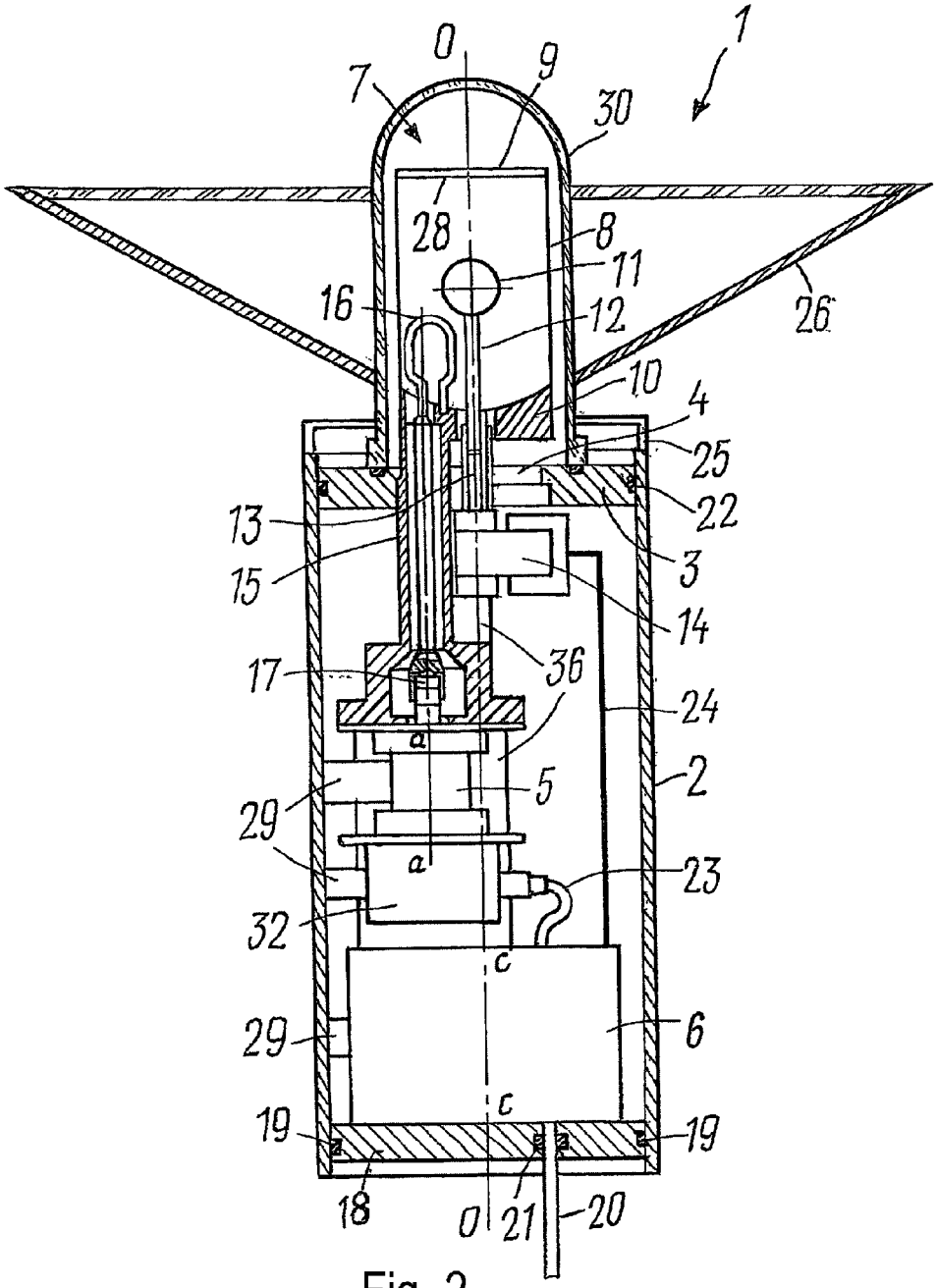
FIG. 2 shows schematically a plasma illumination device, in longitudinal section, the casing of which is made in a cylindrical shape while the reflector is conical, according to the invention.

There is a feasible variant in which the reflector 26 is conical in shape (FIG. 2), this shape being required if large areas are to be illuminated. If a conical light reflector is used, the shape of the bottom of the resonator may be flat, parabolic or spherical.

The electrodeless plasma lamp 11 (FIG. 1) is placed at the focus of the parabolic reflector 26, the light-reflecting end of the microwave resonator 7 with the coupling loop 16 having a light-reflecting coating 28 and being made with a specified curvature, particularly in the form of a partial parabola having the same focus as the parabolic reflector 26.

The illumination device 1 comprises a plurality of heat sinks 29, which are attached to the inner walls of the casing 2 for transferring heat from the magnetron 5, the power source 6, and other heat-generating elements, located in the casing 2, through the wall and flange 18 of the casing 2 to the external environment.

The light-transmitting hermetically sealed hollow cylinder 30 is fitted coaxially and in a hermetically sealed way on the cover 3 of the casing 2 above the microwave resonator 7, and is designed to protect the microwave resonator 7 from the effects of environmental factors.

If the casing 2 is cylindrical in shape, the axis a-a of the magnetron 5 and the axis c-c of the power source 6 are parallel to the axis 0-0 of the casing.

An important characteristic of the construction of said illumination device 1 is the use of a coaxial line 15 with a coupling loop 16 at the input of the microwave resonator 7 for transmitting microwave power from the magnetron 5 to the microwave resonator 7. This characteristic enables the illumination device 1 to be constructed in the form of a cylinder with a relatively small diameter, which is therefore easy to hermetically seal.

Figure 3:
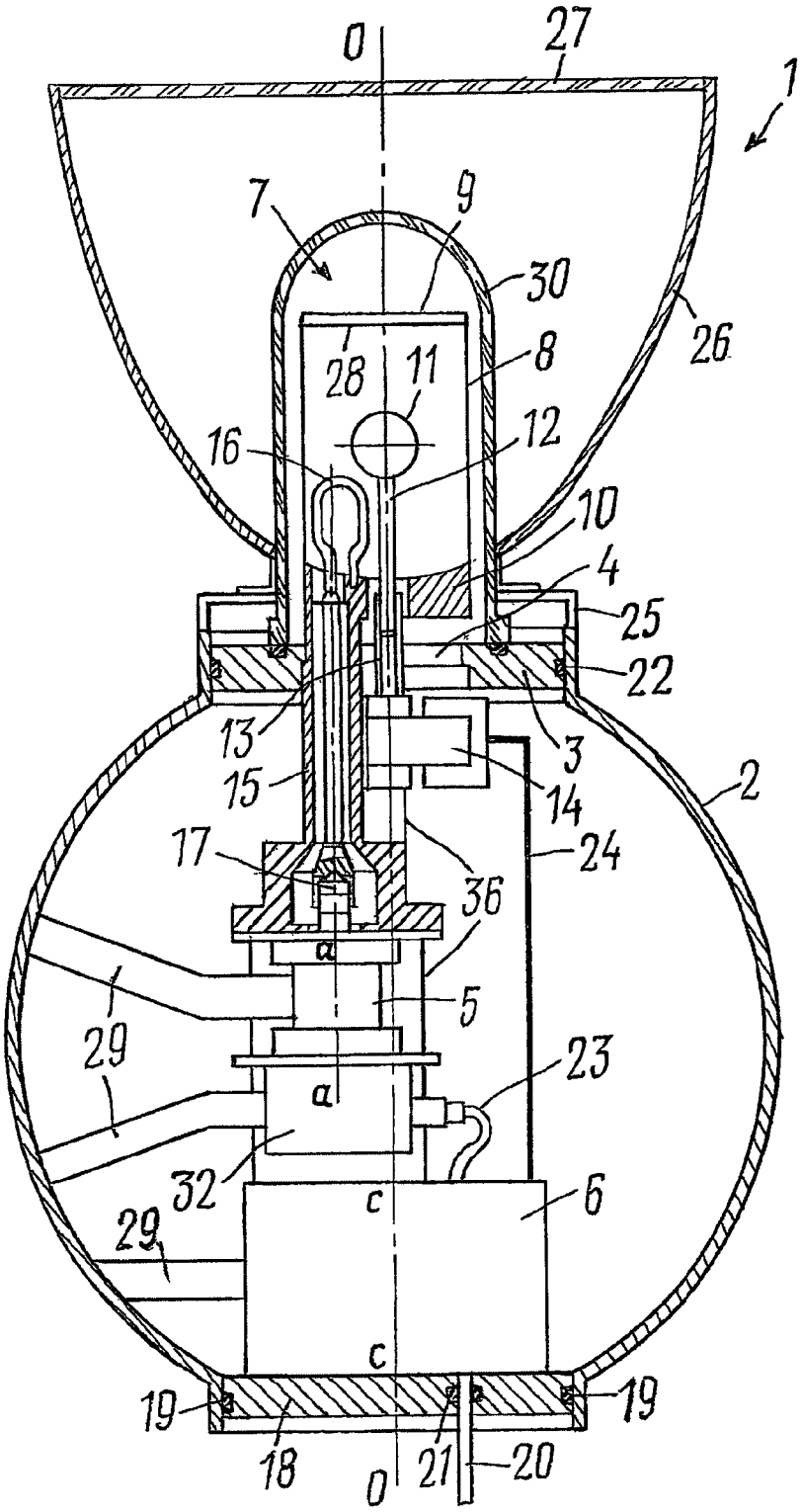
FIG. 3 shows schematically a plasma illumination device, in longitudinal section, the casing of which is made in a spherical shape, according to the invention.

In a feasible variant, the casing 2 is approximately spherical in shape (FIG. 3), the axis a-a of the magnetron 5 and the axis c-c of the power source 6 being parallel to the axis 0-0 of the casing 2.

In a feasible variant, the casing 2 is spherical in shape and the axis of the magnetron 5 and the axis of the power source 6 are perpendicular to the axis 0-0 of the casing 2 (not shown). The construction of the illumination device described above enables it to be used at considerable depths underwater, since a cylindrical or spherical casing can withstand relatively high external pressures, which is not the case with any of the known illumination devices based on electrodeless plasma lamps with microwave pumping.

Figure 4:
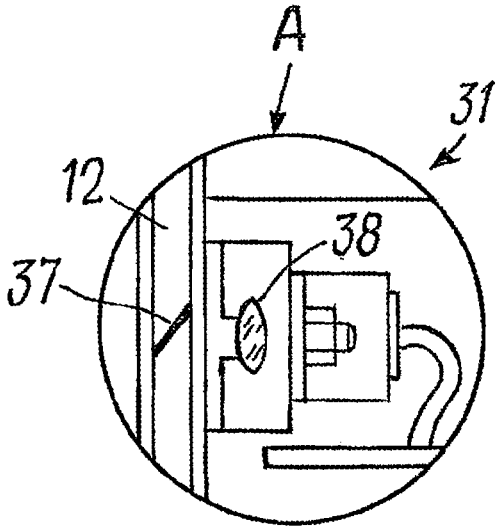
FIG. 4 shows the view A in FIG. 1, illustrating the rotation sensor for determining the rotation of the electrodeless plasma lamp on the basis of the rotation of the support rod, according to the invention.
Figure 6:
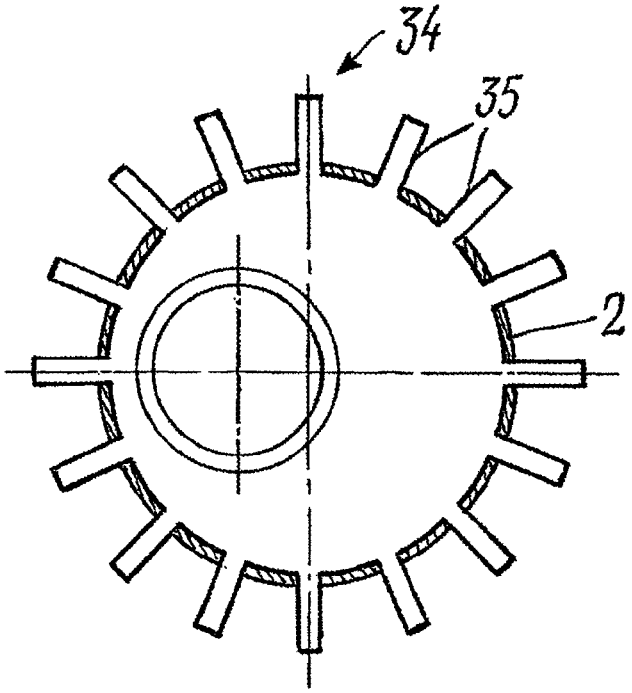
FIG. 6 shows a section taken through the line VI-VI of FIG. 5, according to the invention.

The illumination device 1 also comprises a rotation sensor 31, fitted in the immediate proximity of the attached end of the support rod 12 (FIG. 4) and designed to indicate the rotation of the electrodeless plasma lamp 11, on the basis of the rotation of the support rod 12.

The illumination device 1 also comprises a control unit 32 (FIG. 1), fitted in the hermetically sealed casing 2, for synchronizing the operation of the power supply unit 6, the magnetron 5 and the drive 14 of the support rod 12. The illumination device 1 also comprises a cooling means 33, fitted in the casing 2 (FIG. 5), this cooling means 33, in the variant described here, taking the form of a fan fitted along the axis 0-0 of the casing 2 under the power supply unit 6.

Figure 5:
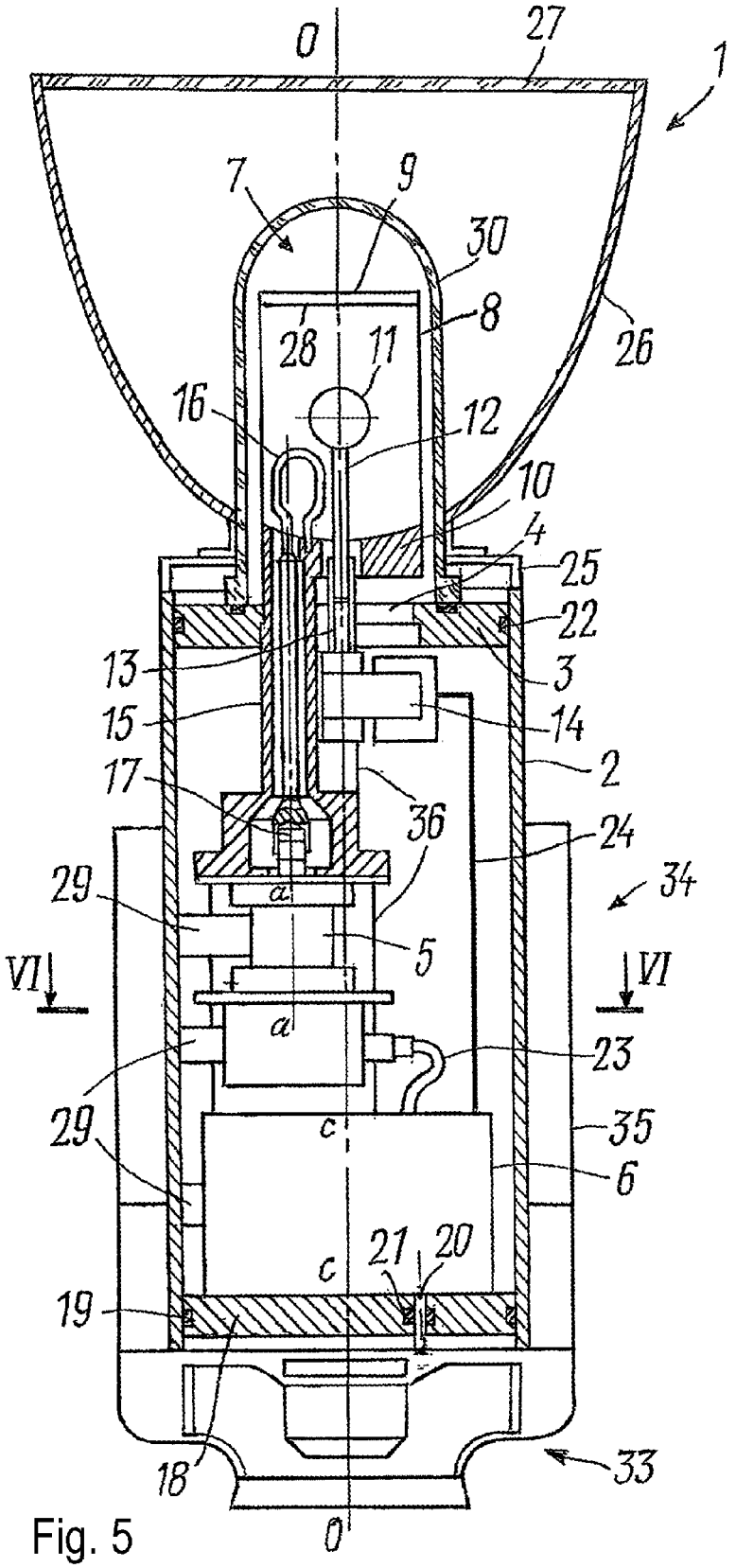
FIG. 5 shows schematically a plasma illumination device, in longitudinal section, on the casing of which ribs are positioned for heat dissipation, according to the invention.

In a feasible variant, the illumination device 1 also comprises a radiator 34, comprising ribs 35 on the outer cylindrical surface of the casing 2 running along the whole length of the casing 2 or along only part of the length, as shown in FIG. 5. This is necessary if the illumination device 1 is used in an air environment, where the heat transfer from the casing to the environment is substantially less than it is in water.

The components of the device 1, including the magnetron 5, the control unit 32, and the drive 14, are fitted on a chassis 36 in the casing.

The plasma illumination device operates in the following manner.

Power is supplied to the control unit 32 (FIG. 1) in the power supply unit 6, which generates the necessary current and voltage to excite the magnetron 5. The magnetron 5 generates microwave radiation which is transmitted along the coaxial line 15 to the microwave resonator 7. Optimal conditions for the operation of the magnetron 5 are provided by the use of a coupling created by corresponding dimensions of the coupling loop 16.

The voltage is supplied to the electric motor 14 for rotating the electrodeless plasma lamp 11 slightly in advance of the supply of voltage to the power supply unit 6.

The action of the microwave field in the electrodeless plasma lamp 11, located at the antinode of the microwave field of the resonator 7, heats the starter gas, causing the formation of vapors of the operating substance, such as sulfur or selenium. The vapors of the operating substance are ionized and radiate light, the radiation spectrum of which depends on the composition of the vapors.

If the device 1 is used under water, the device 1 is first lowered on a line to the specified depth, and power is then supplied by cable from the base vessel (not shown) to the control unit 32 and the power supply unit 6.

During the operation of the device 1, the power supply unit 6 and the magnetron 5 become hot, and heat is given off. Consequently, the heat transfer coefficients from the wall of the casing 2 to the water are very high, and all the heat from the internal heat sources, that is to say the magnetron 5 and the power supply unit 6, is transmitted along the heat sinks 29 to the walls of the casing 2 and is easily transmitted to the external environment. Furthermore, since the power supply unit 6 is fitted on the flange 18 of the casing, the heat given off is also discharged to the environment through the flange 18.

It is practically impossible to overheat the device 1. Temperature sensors (not shown) are fitted inside the casing 2 on each of the heat sources, that is to say the magnetron 5, the power source 6 for the magnetron, and the drive 14, the signal from these sensors being supplied to the control unit 32. If the specified temperature at any of the units is exceeded, the power supply is cut off.

Additionally, the supply to the magnetron 5 is cut off if for any reason the drive 14 stops and the rotation of the support rod 12 ceases, as indicated by the rotation sensor 31. The support rod 12 has a slanting end 37, a beam of light is directed at the end 37 of the rod, the reflected beam strikes the light detector 38, and a pulsating signal is recorded during rotation. The presence of pulsations indicates that the electrodeless plasma lamp 11 is rotating. The lamp 11 is cooled as it rotates. If the pulsating signal is absent, the control unit 32 cuts off the power supply.

Thus, three operating modes are provided in the control unit, namely a no-load mode, a calculated load mode, and a short-circuit mode.

It should be noted that, in order to relieve the water pressure on the reflector 26, the internal volume of the reflector 26 is also filled with water, and the electrodeless plasma lamp 11 with the microwave resonator 7 and the internal volume of the device 1 are protected from water ingress by a light-transmitting hermetically sealed cylinder 30, made of quartz for example.

If the device 1 is intended for operation in a gaseous or air environment, the heat transfer to the external environment is intensified by the ribs 35 (FIG. 5) of the radiator 34 on the outer surface of the casing 2, and additionally by the fan 33 which provides an air flow around the ribs 35.

INDUSTRIAL APPLICATION

The proposed illumination device with microwave pumping may be used to illuminate objects located in unfavorable environmental conditions, particularly those in which there is a high content of dust or other contaminants, or in an aqueous environment at great depths.

The invention claimed is:

1. A plasma illumination device with microwave pumping, comprising:

a hermetically sealed casing, equipped with a cover with an opening, in which a magnetron and a power source, supplying power to the magnetron, are placed along a casing axis;

a microwave resonator, positioned coaxially with the casing axis and having light-transmitting side and end walls and a light-reflecting bottom, fitted in the opening in the cover of the casing; and an electrodeless plasma lamp, fitted in the microwave resonator in an antinodal region and rotatable on a support rod, the other end of which is attached to the drive shaft, an axis of the support rod being coaxial with the casing axis;

a coaxial coupling line running parallel to the casing axis, for transmitting microwave power from the magnetron to the microwave resonator, this line having a coupling loop at the end located in the microwave resonator;

one or more heat sinks located on the inner walls of the casing and providing heat transfer from the magnetron, power source and drive, which are located in the casing and generate heat, through the wall of the casing to the external environment;

and a light-transmitting hermetically sealed hollow cylinder, fitted coaxially and in a hermetically sealed way on the cover of the casing above the microwave resonator, and designed to protect the microwave resonator from the effects of external environmental factors.

2. The plasma illumination device as claimed in claim 1, also comprising:

a rotation sensor, fitted in the immediate proximity of the attached end of the support rod and designed to indicate the presence of rotation of the electrodeless plasma lamp, on the basis of the rotation of the support rod, and a control unit fitted in the hermetically sealed casing to ensure the synchronized operation of the power unit, the magnetron and the support rod drive.

3. The plasma illumination device as claimed in claim 1, wherein the magnetron, control unit and support rod drive of the electrodeless plasma lamp are attached to a chassis in the casing.

4. The plasma illumination device as claimed in claim 1, wherein the casing is cylindrical in shape, with the axes of the magnetron and the power source parallel to the casing axis.

5. The plasma illumination device as claimed in claim 1, wherein the casing is spherical in shape, with the axes of the magnetron and the power source parallel to the casing axis.

6. The plasma illumination device as claimed in claim 1, wherein the casing is spherical in shape, with the axes of the magnetron and the power source perpendicular to the casing axis.

7. The plasma illumination device as claimed in claim 1, wherein the drive for rotating the support rod is fitted in the casing, coaxially with the casing axis.

8. The plasma illumination device as claimed in claim 1, wherein the shape of the bottom of the resonator is flat, parabolic or spherical.

9. The plasma illumination device as claimed in claim 1, which additionally comprises:

a radiator made in the form of ribs fitted on the outer cylindrical surface of the casing.

10. The plasma illumination device as claimed in claim 1, which also comprises a cooling means fitted in the casing.

11. The plasma illumination device as claimed in claim 9, wherein the cooling means is made in the form of a fan.

12. The plasma illumination device as claimed in claim 10, which additionally comprises:

a radiator made in the form of ribs fitted on the outer cylindrical surface of the casing.

* * * * *